United States Patent [19]

Russell

[11] Patent Number: 4,527,378

[45] Date of Patent: Jul. 9, 1985

[54] SEMI-AUTOMATIC INSERTION MACHINE

[75] Inventor: Robert J. Russell, Medford, N.J.

[73] Assignee: Mail-Ex Corporation, Stratford, Conn.

[21] Appl. No.: 337,835

[22] Filed: Jan. 7, 1982

Related U.S. Application Data

[63] Continuation of Ser. No. 106,239, Dec. 21, 1979, abandoned, which is a continuation of Ser. No. 940,728, Sep. 7, 1978, abandoned.

[51] Int. Cl.[3] ..... B65B 67/02

[52] U.S. Cl. ..... 53/266 A; 53/386; 53/381 R; 53/391; 53/502; 493/245; 493/268

[58] Field of Search ..... 53/266 A, 381 R, 386, 53/390, 391, 569, 571, 502; 493/245, 268

[56] References Cited

U.S. PATENT DOCUMENTS

| | | | |
|---|---|---|---|
| 1,543,842 | 6/1925 | Gwinn et al. | 53/266 A |
| 1,960,959 | 5/1934 | Sague | 53/266 A X |
| 2,058,005 | 10/1936 | Donnellan | 53/266 A |
| 2,325,455 | 7/1943 | Williams | 53/266 A X |
| 2,569,219 | 9/1951 | Bamber et al. | 53/266 A |
| 2,788,627 | 4/1957 | Bellows | 53/390 |
| 3,015,926 | 1/1962 | Galambos | 53/384 |
| 3,131,519 | 5/1964 | Webster | 53/266 A X |
| 3,368,321 | 2/1968 | Sather et al. | 53/266 A X |
| 3,410,053 | 11/1968 | Bonsch | 53/266 A X |
| 3,474,711 | 10/1969 | Swinyar | 493/245 X |
| 3,650,773 | 3/1972 | Bush et al. | 53/266 A X |
| 3,935,800 | 2/1976 | Sette et al. | 493/245 X |
| 3,962,848 | 6/1976 | Hankins | 53/266 A |
| 3,965,644 | 6/1976 | Stocker | 53/266 A X |
| 4,079,576 | 3/1978 | Morrison et al. | 53/266 A |

FOREIGN PATENT DOCUMENTS 944255 12/1963 United Kingdom .

*Primary Examiner*—James F. Coan
*Attorney, Agent, or Firm*—Duffield & Lehrer

[57] ABSTRACT

The disclosure is directed to a semi-automatic mail insertion machine which assists an operator in placing materials into envelopes by presenting automatically unfolded and opened envelopes in rapid succession to the operator for manual placement of the materials therein. The machine includes a horizontal conveyor which, under operator control, incrementally advances the envelopes to be processed from one processing station to another in succession. An envelope stacker is positioned above the conveyor and a feed means feeds the envelopes to the conveyor prior to each advancement of the conveyor. The envelopes are conveyed to a first process station which automatically unfolds the pre-folded unsealed envelope flaps. The envelopes are then advanced to a second processing station which opens the envelopes and presents the envelopes to the operator in a manner which permits ready placement of materials into the envelopes. A third processing station may be provided which weighs the envelopes and the material therein to facilitate the sorting of the processed envelopes by weight.

11 Claims, 12 Drawing Figures

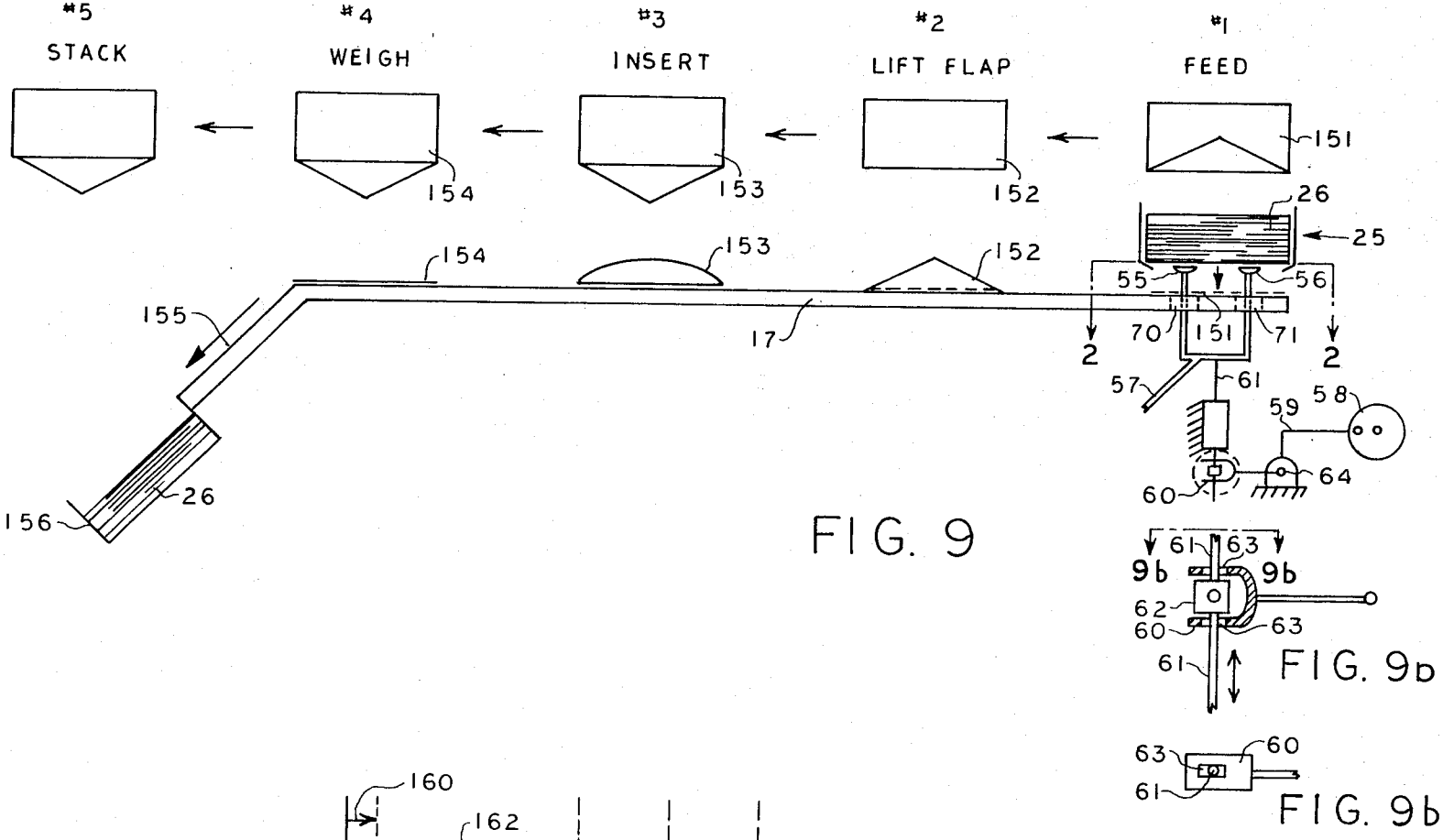
FIG. 9
FIG. 9b
FIG. 9b
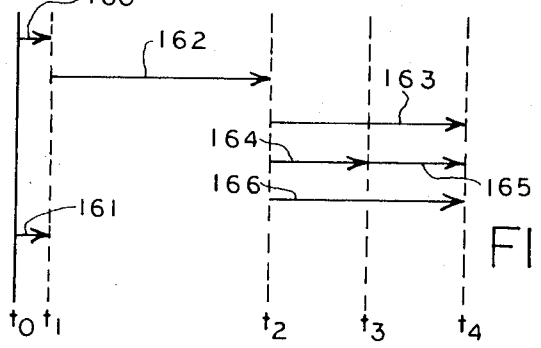
FIG. 10

SEMI-AUTOMATIC INSERTION MACHINE

This application is a continuation of application Ser. No. 106,239, filed Dec. 21, 1979, now abandoned, which, in turn, was a continuation of application Ser. No. 940,728, filed Sept. 7, 1978, now abandoned.

BACKGROUND OF THE INVENTION

The present invention is directed to a machine for inserting materials into envelopes, and more particularly to a semi-automatic machine for assisting an operator in placing materials into envelopes.

There are many commercial environments where thousands of mail pieces must be processed each day. For example, banks, utility companies and the like must prepare extremely large numbers of mail pieces to be sent out to their customers on a daily basis. The preparation of the mailing pieces usually includes the placing of materials in the form of, for example, cancelled checks or bills for customers into envelopes. While it may appear that the opening of an envelope and the placing of materials therein is a simple matter, this procedure is in actuality laborious and time-consuming, costing such businesses thousands of dollars each year.

To reduce the cost of preparing such mailings, various forms of fully automatic "envelope stuffing" machines have been developed. These machines are very complicated and expensive, costing hundreds of thousands of dollars and, as has been found in practice, can only be economically employed for very large mail-processing workloads. Hence, such machines are suitable only for very large banks, utility companies, or the like.

There are many businesses, on the other hand, which must prepare mailings which are too small in number to substantiate, economically, the utilization of a fully automatic machine, but which are too large in number to economically employ the required personnel for manual mail preparation. Such may be the case in small banks or rural utility companies for example. Hence, there is a need in the art for a machine which is inexpensive in comparison to the cost of fully automatic envelope stuffing machines, but which will enable mail preparation by relatively few operators at a rate which satisfies mail preparation workloads that are too small to justify a fully automatic machine and too large to justify the employ of manual personnel.

It is therefore a general object of the present invention to provide an improved semi-automatic mail inserting machine for assisting an operator in placing materials to be mailed into envelopes.

It is a more particular object of the present invention to provide such a machine which automatically unfolds the prefolded unsealed flaps of the envelopes and presents the envelopes to an operator in an opened condition in a manner which facilitates ready placement of materials into the envelopes.

It is still a more particular object of the present invention to provide such a machine which presents the opened envelopes to the operator in rapid succession and under operator control.

SUMMARY OF THE INVENTION

The invention provides an improved semi-automatic insertion machine for assisting an operator in the placing of materials into envelopes of the type having a body and an adjacent seal flap prefolded in an unsealed closed position over the body. The machine comprises a plurality of process stations, conveying means for transporting a plurality of envelopes in succession to each of the process stations, envelope storing means adjacent the conveying means for maintaining a plurality of envelopes to be processed in a ready condition, and envelope transferring means for transferring the envelopes one at a time in succession from the envelope storing means to the conveying means. The machine also includes envelope flap unfolding means at a first one of the process stations for bending the flap of each envelope from its prefolded unsealed closed position to a position substantially in line with its body, and envelope opening means at a second one of the process stations for disposing each envelope in an opened condition to facilitate the placing of materials therein by an operator.

BRIEF DESCRIPTION OF THE DRAWINGS

While the features of the invention believed to be novel are set forth with particularity in the appended claims, the further objects and advantages thereof may best be appreciated by making reference to the following description, taken in conjunction with the accompanying drawings, wherein the several figures of which like reference numerals indicate identical elements and wherein:

FIG. 9 is a diagrammatic side view illustrating the operation of the machine of FIG. 1, and illustrating the condition of the envelopes at each stage of the process performed on the envelopes by the machine;

FIGS. 9*a* and 9*b* illustrate in more specific detail a particular aspect of the envelope feed means of the machine of FIG. 1; and FIG. 10 is a graphical representation of the machine timing for each process performed on the envelopes by the machine.

DESCRIPTION OF THE PREFERRED EMBODIMENT

Figure 1:
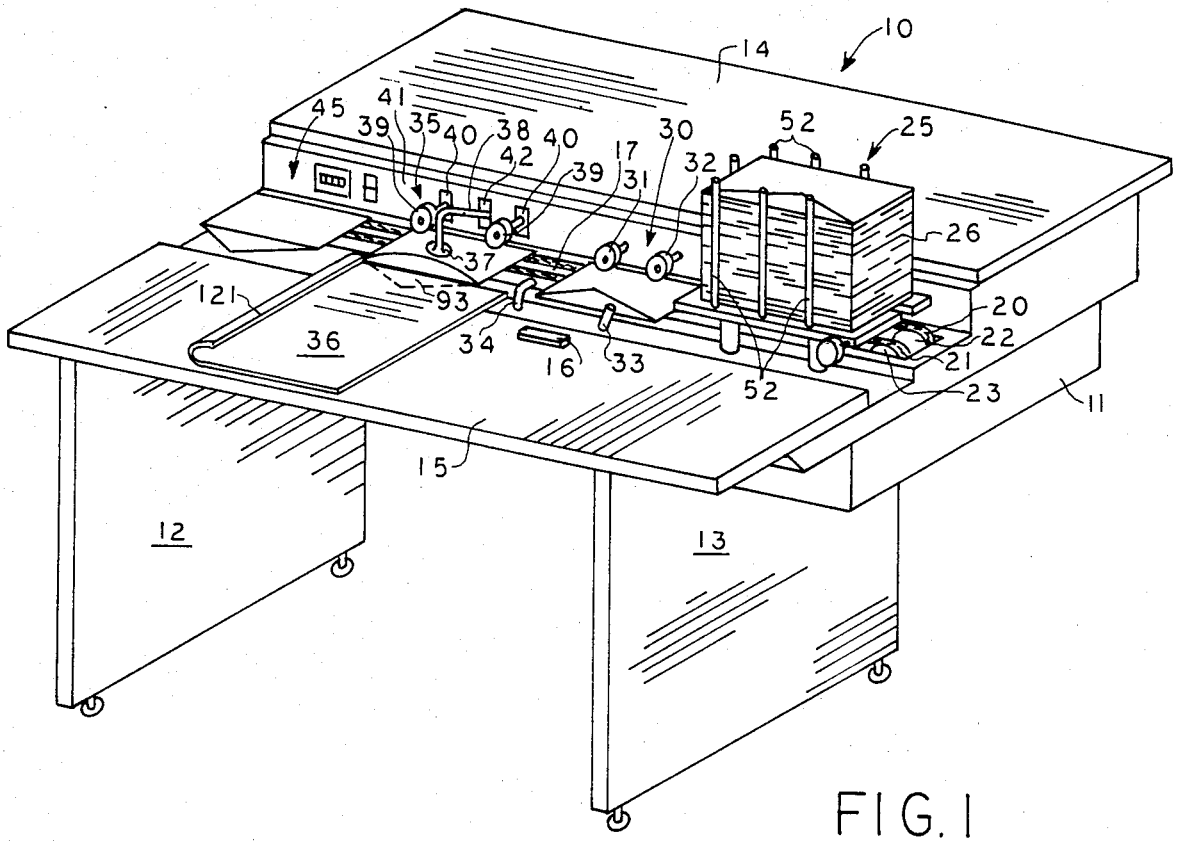
FIG. 1 is a perspective view of a semi-automatic mail insertion machine embodying the present invention.

Referring now to FIG. 1, the machine 10 there illustrated and which embodies the present invention, includes a substantially horizontal frame 11 which is supported by a pair of pendant legs 12,13. On top of the frame 11 is an upper horizontally disposed surface 14 upon which envelopes and materials to be inserted therein may be placed for convenient access. A lower horizontal surface 15 is provided to form a work surface for the operator. Within the work surface 15 is a push or press arm 16 which is depressed by the operator to cause the machine to sequence for processing the envelopes in a manner to be described subsequently. Between the horizontal surfaces 14 and 15 is located a conveying means which includes a substantially horizontal top plate 17. The conveying means also comprises a pair of belts 20 and 21 which are caused to travel along the conveyor top surface 17 by rotating wheels 22 and 23.

An envelope storing means in the form of an envelope hopper or stacker 25 is disposed adjacent to the conveying means and more particularly above the conveyor. An envelope feed means to be described hereinafter is located beneath the conveyor top surface and transfers the bottom envelope of the envelope stack 26 one at a time in succession upon each depression of the press bar 16. Of course, a foot pedal or other actuating device may be utilized as well in sewing the function of press bar 16.

The machine 10 is particularly adapted for precessing envelopes of the kind which have a body comprising a pair of side walls or panels and an adjacent seal flap adjoining one of the sidewalls and prefolded in an unsealed closed position, over the body. For processing envelopes of this kind to facilitate the insertion of materials therein, the machine 10 includes along the horizontal conveyor a plurality of processing stations. A first processing station 30 unfolds the prefolded unsealed envelope flaps to dispose the envelope flaps in a substantially in line orientation with respect to the envelope bodies. A second processing station 35 is also provided along the horizontal conveyor which opens the envelope and presents the envelopes to the operator in an opened condition in a manner which facilitates the ready insertion of materials into the envelopes. A third processing station 45 may be provided to facilitate weighing of the processed envelopes to facilitate sorting of the processed envelopes by weight, for example, or can be utilized as an idle station for conveniently discarding defective envelopes or the like.

Figure 2:
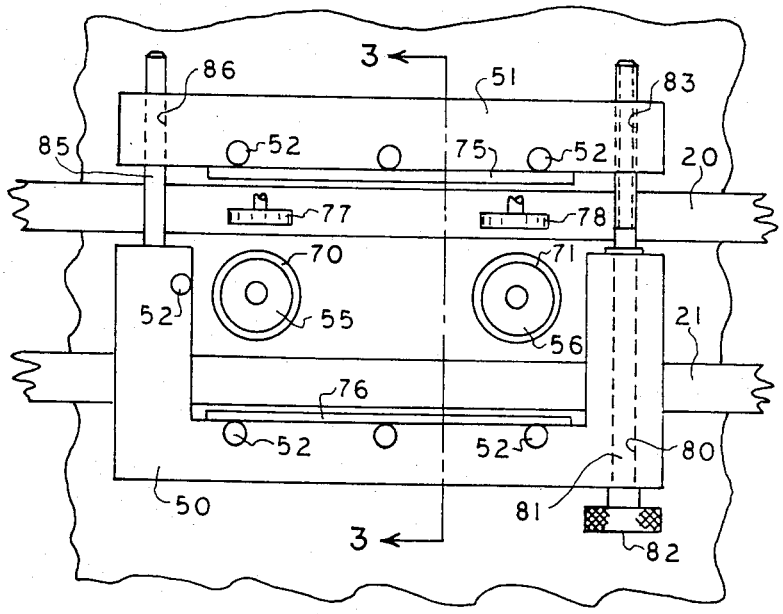
FIG. 2 is a cross-sectional view taken along lines 2—2 of FIG. 9, illustrating particular details of the envelope storing means and the envelope feed means of the machine of FIG. 1.
Figure 3:
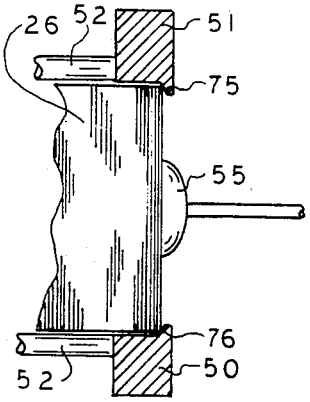
FIG. 3 is a cross-sectional view taken along lines 3—3 of FIG. 2.

The envelope storing means or hopper 25 includes a horizontal support for the envelopes which comprises a substantially U-shaped member 50 and a coacting member 51. Along the members 50 and 51 are a plurality of support posts 52 which extend upwardly from the members 50 and 51 and which define a confinement boundary for the envelopes 26. As can be seen in FIGS. 2, 3 and 9, the envelope feed means beneath the top plate of a conveyor includes a pair of suction cups 55 and 56 which are arranged for reciprocating movement and which are also coupled to a source of negative pressure by a line 57. Referring particularly to FIG. 9, the suction cups 55 and 56 are caused to reciprocate upwardly and downwardly by a mechanism which includes a cam 58, a link 59, a yoke shaped coupling member 60, and a vertical rod 61. The vertical rod 61 as best seen in FIG. *9a*, is coupled to the yoke member 60 by a collar 62 which receives the rod 61 through a pair of slots 63 in the coupling member 60. As the cam 58 rotates, the link member 51 will pivot about a pivot point 64 to cause the coupling member 60 to reciprocate upwardly and downwardly. Because the rod 61 is confined on the coupling member 60 by the collar 62, the rod in turn will reciprocate in movement and cause the suction cups 55 and 56 to reciprocate upwardly and downwardly. As the suction cups move upward towards the stack of envelopes, the source of negative pressure is actuated to cause the suction cups 55 and 56 to grip the bottom envelope of the stack 26 and carry it downwardly into engagement with the conveyor belts 20 and 21. After Bringing the bottom envelope into engagement with the conveyor, the suction cups 55 and 56 will retract into a pair of apertures 70 and 71 within the conveyor top plate 17 where they will remain until the next envelope is to be transferred from the stack 26 to the conveyor belts.

Referring again to FIGS. 2 and 3, it can be seen that the members 50 and 51 of the envelope storing means include an elongated lip portion 75 and 76 having an inclined surface which aids the suction cups in pulling the bottom envelope from the stack. After the envelope is transferred from the stack to the conveyor belts 20 and 21, a pair of idler pressure rollers schematically illustrated at 77 and 78 are brought into engagement with the envelope to releaseably hold the envelope in engagement with the conveyor belt 20 immediately prior to and during the transportation of the envelope from the feed station to the envelope flap unfolding station.

The horizontal bottom support for the envelope stack 26 which comprises the members 50 and 51 may be adjusted to accommodate envelopes of many different sizes. To that end, it can be seen that the substantially U-shaped member 50 includes a bore 80 which receives an elongated threaded member 81 having an end knob 82. The threaded member 81 extends through the bore 80 and into a threaded bore 83 of member 51. Also, guide rod 85 extends from the substantially U-shaped member 50 to and through a second bore 86 of the member 51. As a result, as the knob 82 is turned, the spacing between the envelope support lips 76 and 75 may be varied to accommodate many different size envelopes.

Figure 4:
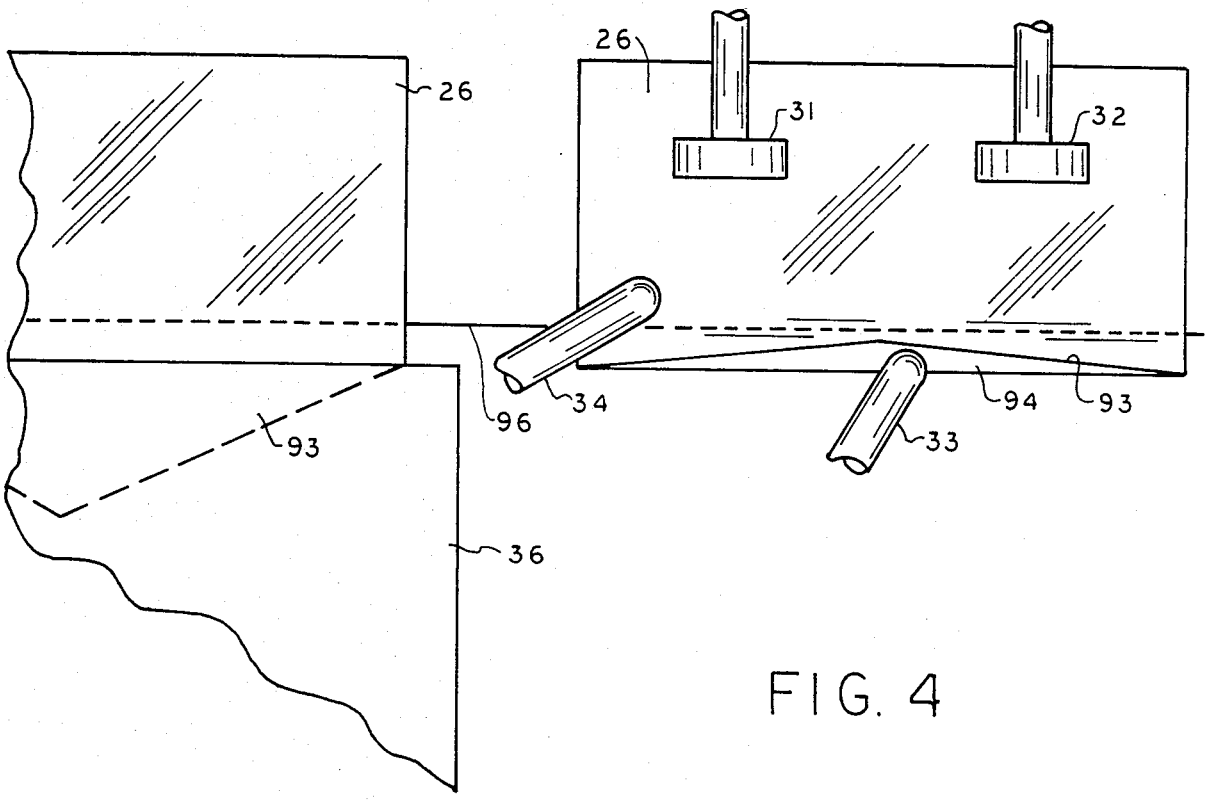
FIG. 4 is a partial top plan view illustrating the manner of operation of the envelope flap unfolding means of the machine of FIG. 1.
Figure 5:
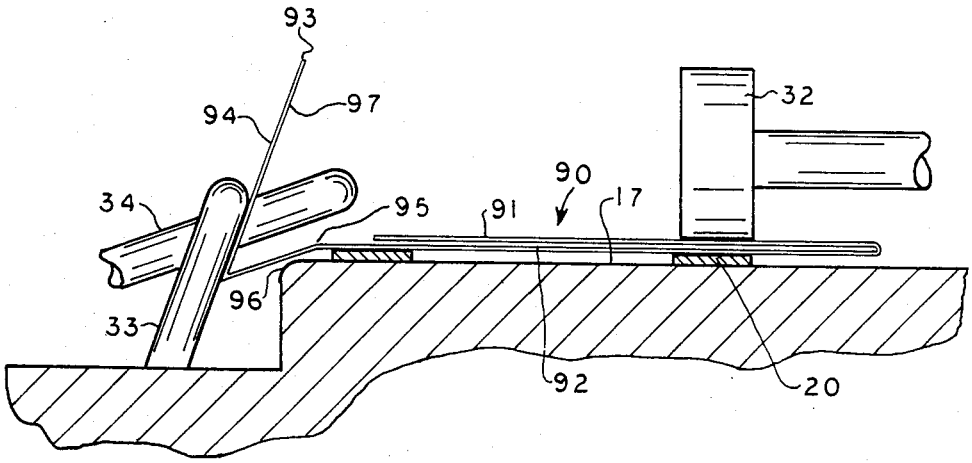
FIG. 5 is a partial side view of the envelope flap unfolding means of FIG. 4.

After an envelope is fed to the conveyor in the manner previously described, upon depression of the press bar 16, the conveyor belts 20 and 21 will increment causing the envelope to travel from the feed station to the first processing station which unfolds the pre-folded unsealed flap of the envelope. To that end, the flap unfolding processing station includes a pair of pressure rollers 31 and 32, a deflection post 33, and a straightener post 34. The rollers 31 and 32 are vertically disposed with respect to the horizontal belts and are mounted to shafts fixed to a vertical panel 41 of the machine. Referring specifically to FIGS. 4 and 5, the body 90 of the envelope comprising side panels 91 and 92 is captured between the pressure rollers 31 and 32 and the conveyor belt 20. The flap 93 of the envelope which adjoins the envelope sidewall 92 and which was pre-folded over the envelope body is deflected to a partially unfolded position by the deflection post 33. The deflection post 33 engages the external surface 94 of the flap 93 causing the envelope sidewall 92 to bend at 95 around the corner 96 of the conveyor top plate 17. As a result, the flap 93 is partially unfolded as illustrated in FIG. 5 and is ready to be received by the straightener bar 34.

The straightener bar 34 engages the internal surface 97 of the flap 93 and is disposed at an angle both vertically and horizontally with respect to the corner edge 96 of the conveyor top plate 17. As a result, the straightener bar 34 will cause the envelope flap 93 to further unfold and pass underneath the straghtener bar 34 as the envelope travels from the flap unfolding processing station 30 to the envelope opening processing station 35.

The envelope opening processing station 35 includes a guide plate 36, a suction cup 37, an arm 38 connected to the suction cup 37, and a pair of pressure rollers 39 mounted on shafts which extend through a pair of slots 40 of the vertical panel 41 of the machine. Likewise, the arm 38 extends through a slot 42 of the vertical panel 41.

Figure 6:
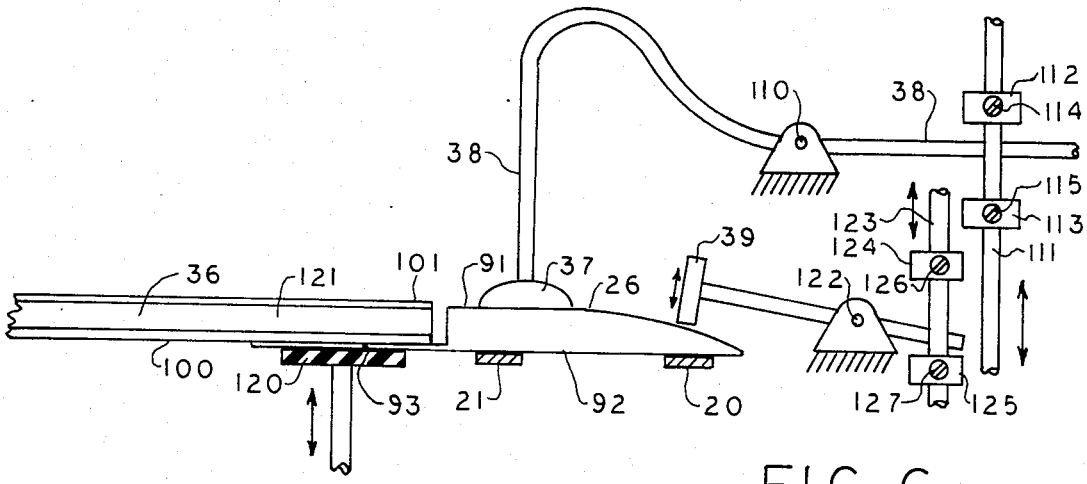
FIG. 6 is a side view, primarily in diagrammatic form, illustrating the envelope opening means of the machine of FIG. 1.

Referring to FIGS. 4 and 6, it can be seen that the bottom surface 100 of the guide plate 36 at its end 101 is spaced slightly above the upper surface of the conveyor belts 20 and 21. As a result, when the envelope 26 is transported from the unfolding processing station 30 to the envelope opening process station 35, the envelope flap 93 passes beneath the guide plate 36. After the conveyor has incremented and the flap 93 is fully beneath the guide plate 36, the conveyor stops and the arm 38 lowers so that the suction cup 37 grips the side panel 91 of the envelope which is opposite the flap 93 and its adjoining side panel 92. As in the case of the suction cups 55 and 56 of the conveyor feed station, the suction cup 37 is coupled to a source of negative pressure through the arm 38. It reciprocates in an upward and downward direction by the arm 38 being pivoted at a pivot point 110. Pivotal action of the arm 38 is afforded by a reciprocating linkage 111 which is coupled to the arm 38 by a pair of collars 112 and 113. The collars are secured to the linkage 111 by set screws 114 and 115 and may be positioned along the linkage for adjusting the degree of travel of the arm 38 and the suction cup 37. Just prior to the suction cup 37 being lowered, the negative air pressure is administered to the arm 38 so that by the time the suction cup 37 engages the panel 91 of the envelope 26, it will grip the envelope panel 91. As the arm 38 moves the suction cup 37 upwardly, the suction cup will cause the panel 91 to raise.

A pressure pad 120 is provided and also is arranged for reciprocal movement. The pressure pad 120, prior to the raising of the suction cup 37, is caused to move upwardly and confine the flap 93 between the pressure pad 120 and the bottom surface 100 of the guide plate 36. As a result, as the suction cup 37 raises and causes the envelope panel 91 to in turn raise, the envelope will open due to the fact that the flap 93 is confined in a substantially horizontal position in line with its adjoining panel 92. The pressure rollers 39 although out engaged with the envelope as the envelope is opened, is spaced just above the envelope so that the end of the envelope opposite the flap 93 will not rise up as the envelope is opened by the suction cup 37.

After the envelope is opened, it is presented to the operator in a manner which facilitates the ready insertion of materials into the envelope. As can be seen in FIG. 1, the guide plate 36 is positioned so that the operator may place the materials to be inserted into the envelope on the guide plate and merely pushes the materials along the guide plate and into the envelope. The guide plate 36 is provided with a curved side portion 121 to further aid in the guiding of the materials into the envelope 26.

After the materials are inserted into the envelope, the operator then depresses the press bar 16 which causes a solenoid to act to release the air pressure within the arm 38 and suction cup 37. As a result, the envelope panels 91 and 92 will rapidly collapse to ready the envelope for further transportation to the next processing station. Also, as the press bar 16 is depressed, the pressure rollers 39 will be caused to pivot about a pivot point 122 by a linkage 123 to cause the envelope to engage the conveyor to assure transportation of the envelope from the envelope opening station to the next processing station. As can be seen in FIG. 6, the link 123 has a pair of collars 124 and 125 which include set screws 126 and 127 which provide an adjustment for the degree of travel of the pressure rollers 39. Because the pressure rollers are pivotal about the pivot point 122, they releaseably hold the envelope into engagement with the conveyor and may be readily moved out of the way during the envelope opening process.

Figure 7:
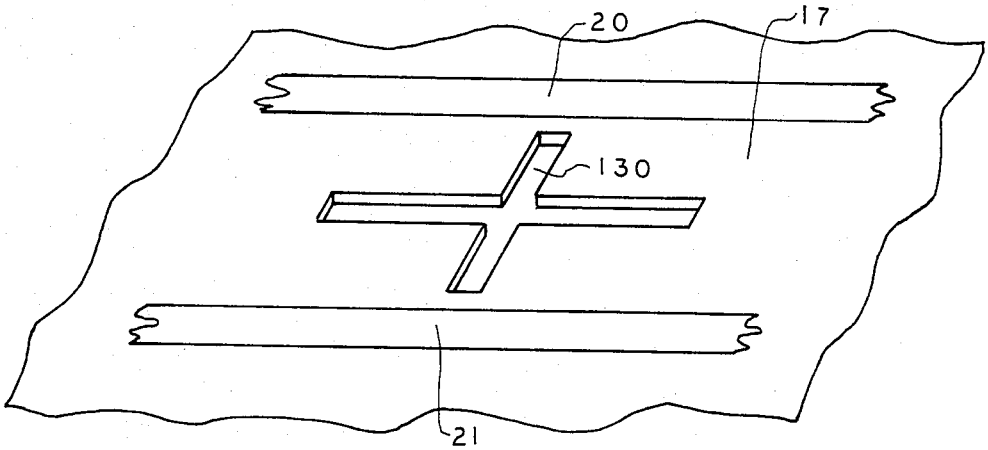
FIG. 7 is a partial perspective view of a criss-cross aperture provided in a top plate of the machine of FIG. 1 which facilitates the weighing of the processed envelopes.

After the envelope has been opened and the materials inserted therein, it is transported to the third processing station 45 which may be an idle station as previously described or may be a station which provides an ancillary function which contributes to the efficiency of the mail preparation process afforded by the machine of the present invention. Specifically, the third processing station may be of the type which weighs the processed envelopes to facilitate sorting of the processed envelopes by weight. To that end, reference may be made to FIGS. 7 and 8, which illustrate such a weighing mechanism. In FIG. 7, it can be seen that between the conveyor belts 20 and 21, a criss-cross aperture 130 is provided within the conveyor top plate 17. Through the criss-cross aperture 130 a weighing platform may be raised to engage the envelopes.

Figure 8:
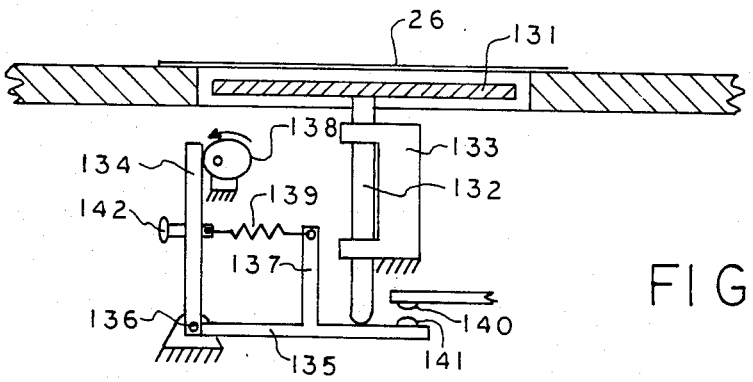
FIG. 8 is a side-view partially in cross-section of a weighing apparatus which may be employed for weighing the processed envelopes and which may be utilized in the machine of FIG. 1.

FIG. 8 shows the weighing apparatus prior to engagement of the platform 131 with an envelope 26. The weighing apparatus includes the platform 131, a rod 132 coupled to the platform 131, a guide 133 for the rod 132, a first arm 134, a second arm 135, a pivot 136, and a spring 139. The first arm 134 and second arm 135 are independently pivotal about the pivot 136 but are coupled together by the spring 139 which extends between the first member 134 and an extension 137 of the second member 135. A rotating eccentric cam 138 is provided which, when rotated, deflects the first arm 134 to place the spring 139 under tension. This causes the second arm 135 to pivot about the pivot point 136 and to in turn cause the rod 132 to rise vertically for engaging the platform 131 with the envelope 26. If the envelope 26 weighs more than a predetermined weight, determined by the tension of spring 139, the platform will not be able to rise up a sufficient distance so as to cause a pair of contacts 140 and 141 to make contact. However, if the envelope is below a certain weight, the platform will be caused to rise up a sufficient distance so that the contacts 140 and 141 will engage. These contacts may be utilized in an indicating system for turning on a light or a buzzer for example to indicate that the envelope is below a predetermined weight for sorting purposes. The tension of spring 139 may be adjusted for different predetermined envelope weights to be detected by the turning of a threaded member 142 arranged to vary the spring tension in a known manner.

The operation of the machine will now be summarized by making reference to FIGS. 1, 9 and 10. Assuming that a plurality of envelopes 26 have been placed into the hopper 25 for ready use, and assuming that sufficient envelopes have been processed so that there is an envelope at each of the processing stations, the machine will be in a condition such that a first envelope 151 will be resting on the conveyor at the feed station, a second envelope 152 will be partially opened at the unfolding station, a third envelope 153 will be at the envelope opening station and have materials inserted therein, and a fourth envelope 154 will be at the weighing station and has been weighed. When the operator depresses the press bar 16 at $t_0$, the suction cup 37 holding envelope 153 open will release the envelope through the termination of the air suction therethrough by a fast-acting solenoid in a time indicated by the arrow 160. Simultaneously, the pressure pad 120 (FIG. 6) will release the flap of the envelope during the time indicated by arrow 161. These functions are accomplished at $t_1$ at which time the conveyor is caused to increment for a time indicated by arrow 162. The conveyor is energized for a sufficient time to cause each of the envelopes to be aligned with its next respective processing station. At this time, $t_2$, the conveyor stops. At $t_2$, the feed means at the feed station will feed a new envelope onto the conveyor by the raising of the suction cups 55 and 56 into engagement with the bottom envelope of the stack 26. The air suction through the suction cups 55 and 56 is initiated immediately prior to the engagement of the suction cups with the bottom envelope. The suction cups 55 and 56 are then caused to move downwardly in a manner previously described to place the envelope onto the conveyor. The envelope is thereby placed onto the conveyor and is ready for processing during the time period indicated by the arrow 163, which terminates at $t_4$, the ending of the processing cycle. Also at $t_2$ the envelope just conveyed to the opening station is caused to be opened during a time indicated by the arrow 164 which terminates at $t_3$. During the time period indicated by the arrow 164, the arm 38 and suction cup 37 are lowered into engagement with the envelope with negative air pressure being initiated immediately prior to the suction cup 37 engaging the envelope. The suction cup 37, after gripping the envelope is then caused to move upwardly to open the envelope and present it to the operator in a condition to facilitate the ready insertion of the materials into the envelope. This function is completed by $t_3$. The time period between $t_3$ and $t_4$, indicated by arrow 165, is provided to give the operator time to place the materials into the envelope. If the operator is operating the machine at maximum efficiency, he will be afforded the time period indicated by the arrow 165 for accomplishing that function. However, it is to be understood that the operator could take a longer period of time to insert the materials into the envelope before the press bar to initiate a new cycle.

Lastly, at $t_2$, the weighing station is caused to weigh the envelope just conveyed to it during the time period indicated by the arrow 166. During this time period, the cam 138 (FIG. 8) is caused to rotate in the direction indicated to place the spring 139 under tension to cause the platform 131 to rise up in the manner previously described for weighing the envelope above the platform. After the envelope has been weighed and responsive to the indication provided by the indicating means coupled to the contacts 140 and 141, the operator can then take the envelope just weighed and send it down a discharge ramp 155 for placing the envelope into a discharge hopper 156 which stacks the envelopes 26 in an orderly fashion to facilitate the placing of the envelopes into suitable postage machines which are well known in the art. These postal machines are adapted to reclose the flaps of the envelopes, seal the envelopes, and place the appropriate amount of postage onto the envelopes.

From the foregoing, it can be seen that the present invention provides a new and improved apparatus for processing mail pieces. More particularly, the present invention provides a semi-automatic mail insertion machine which assists an operator in the placing of materials into envelopes for mailing. The machine of the present invention presents each of the envelopes to be processed to the operator in an open condition in a manner which facilitates the ready placement of the materials into the envelopes. The machine also automatically unfolds the prefolded envelope flaps and presents the opened envelopes to the operator in rapid succession under control by the operator. As a result, large numbers of mailing pieces may be processed without the need of employing a fully automatic envelope stuffing machine which, as previously explained, are very expensive and complicated. Hence, the semi-automatic mail insertion machine of the present invention provides a better solution to the problem. Specifically, the machine of the present invention provides sufficient assistance to an operator so that mail processing workloads which are too large to be handled by manual personnel, but which are too small to substantiate investment of a fully automatic machine may be satisfied.

While a particular embodiment of the present invention has been shown and described, modifications may be made, and it is therefore intended to cover in the appended claims all such changes and modifications which fall within the true spirit and scope of the invention.

The invention is claimed as follows:

1. A machine for facilitating the manual insertion of materials by an operator into envelopes of the type having a body and an adjacent seal flap prefolded in an unsealed closed position over said body, said machine comprising: a hopper for containing a quantity of envelopes; an inserting station; conveying means for transporting the envelopes in succession from said hopper to said inserting station; a table top extending along and adjacent to said conveying means; said conveying means being adapted for transferring the envelopes from said hopper to said inserting station in a substantially horizontal disposition with said envelope flaps facing said table top; envelope flap unfolding means for bending the flap of each envelope towards said table top from its prefolded unsealed closed position to a position substantially in line with its body; a guide plate associated with said table top adjacent to said inserting station and arranged to receive the unfolded envelope flaps thereunder; envelope opening means at said inserting station for disposing each envelope in an opened condition facing said guide plate to facilitate the manual guiding of materials along said guide plate towards the opened envelopes and the manual insertion of the materials into the envelopes by an operator; and means for releasably holding the envelopes in engagement with said conveying means comprising a pair of rollers located at said inserting station, said rollers being arranged for reciprocating movement for being spaced from the envelopes while the envelopes are opened and for engaging the envelopes during transportation of the envelopes by said conveying means.

2. A machine as defined in claim 1 wherein said conveying means comprises a substantially horizontal top plate and a pair of traveling belts arranged along said top plate and arranged for supporting the envelopes in said substantially horizontal disposition and wherein said rollers are adapted to engage the envelopes and force the envelopes into firm engagement with one of said belts.

3. A machine for facilitating the manual insertion of materials by an operator into envelopes of the type having a body and an adjacent seal flap prefolded in an unsealed closed position over said body, said machine comprising: a hopper for containing a quantity of envelopes; an inserting station; conveying means for transporting the envelopes in succession from said hopper to said inserting station; a table top extending along and adjacent to said conveying means; said conveying means being adapted for transferring the envelopes from said hopper to said inserting station in a substantially horizontal disposition with said envelope flaps facing said table top; envelope flap unfolding means for bending the flap of each envelope towards said table top from its prefolded unsealed closed position to a position substantially in line with its body, said envelope flap unfolding means comprising first means for partially unfolding the envelope flaps and second means for bending the envelope flaps from the partially unfolded position to said position substantially in line with the envelope bodies; a guide plate associated with said table top adjacent to said inserting station and arranged to receive the unfolded envelope flaps thereunder; and envelope opening means at said inserting station for disposing each envelope in an opened condition facing said guide plate to facilitate the manual guiding of materials along said guide plate towards the opened envelopes and the manual insertion of the materials into the envelopes by an operator.

4. A machine as defined in claim 3 wherein said second means is arranged to act upon the envelope flaps subsequent to said first means engaging the envelope flaps.

5. A machine as defined in claim 3 wherein said conveying means includes a substantially horizontal top surface and is arranged to transport the envelopes in a substantially horizontal orientation along said top surface, wherein said first means comprises a deflection member adapted to engage the external surface of the envelope flaps for bending the flaps to the partially unfolded position and wherein said second means comprises a straightener member arranged to subsequently engage the internal surface of the partially unfolded envelope flaps to further bend the flaps to said position substantially in line with said envelope bodies.

6. A machine as defined in claim 5 wherein said envelope flap unfolding means further comprises pressure means disposed to engage the envelope bodies and hold the envelope bodies against said conveying means top surface as said deflection member and said straightener member act upon the envelope flaps.

7. A machine as defined in claim 6 wherein said pressure means comprises at least one pressure roller vertically disposed with respect to said conveying means top surface.

8. A machine as defined in claim 7 wherein said pressure means comprises a pair of said pressure rollers.

9. A machine for assisting an operator in the manual insertion of materials into envelopes of the type having a body comprising a pair of sidewalls and an adjacent seal flap adjoining one of said sidewalls and prefolded in an unsealed closed position over said body, said machine comprising: a hopper for maintaining a quantity of envelopes; an envelope opening station; a horizontal conveyor for transporting a plurality of envelopes in a substantially horizontal orientation in succession from said hopper to said envelope opening station; a substantially horizontal table top surface extending along and adjacent to said conveyor defining an operator work position on its side opposite said conveyor; envelope feed means for transferring the stacked envelopes one at a time in succession from said hopper to said conveyor; envelope flap unfolding means adjacent said conveyor between said hopper and said envelope opening station including first means for partially unfolding the prefolded envelope flaps in a direction towards said operator work position and second means for bending the partially unfolded flaps to a position substantially in line with the envelope bodies as the envelopes are transported to said opening station from said hopper; and an insertion guide plate adjacent said opening station associated with said table top surface and arranged for receiving the unfolded envelope flaps thereunder, said envelope opening station including flap constricting means for holding the envelope flaps against the undersurface of said guide plate substantially in line with their adjoining body sidewalls and a reciprocating means arranged to engage and pull the other envelope body sidewalls away from the constricted flaps and adjoining sidewalls by a distance sufficient to open the envelopes in facing relation towards said guide plate to facilitate the manual guiding of materials by an operator along said guide plate towards the opened envelopes and the insertion of the materials therein by an operator.

10. A machine for facilitating the manual insertion of materials by an operator into envelopes of the type having a body and an adjacent end seal flap prefolded in an unsealed closed position over said body, said machine comprising: a hopper for containing a quantity of envelopes; an inserting station; conveying means for transporting the envelopes in succession from said hopper to said inserting station; a table top generally horizontally disposed and with one side extending along substantially the length of and adjacent to said conveying means defining an operator work position on its side opposite said conveying means; said conveying means being adapted for transferring the envelopes from said hopper to said inserting station longitudinally of said table top in a substantially horizontal disposition with said envelope flaps facing said work position; envelope flap unfolding means intermediate the hopper and inserting station for bending the flap of each envelope towards said work position from its prefolded unsealed closed position to a position substantially in line with its body as the envelopes are transported by said conveying means to said inserting station from said hopper; a guide plate associated with said table top adjacent to said inserting station and arranged to receive the unfolded envelope flaps thereunder with the opposite closed ends of the envelopes unconfined to permit separation of the envelope side panel portions throughout their extents to the closed ends, and envelope opening means at said inserting station engageable with the upper envelope side panel portions for disposing each envelope in an opened condition facing said guide plate and said operator work position to facilitate the manual guiding of materials along said guide plate towards the opened envelopes and means maintaining the unfolded flaps and the integrally contiguous envelope lower side panel portions in substantially planar relationship from the flaps beneath the guide plate to the opposite unconfined closed envelope ends with permissive elevation of the upper envelope side panel portions by the opening means throughout their extents to the closed ends to facilitate the manual insertion of the materials completely into the envelopes by an operator.

11. A machine as defined in claim 10 wherein the guide plate is essentially coplanar with and forms essentially a part of said table work surface, with a portion extending away from the operator work position and arranged to receive the unfolded flaps thereunder, and with the envelope body portions in position over the conveying means at the inserting station.

* * * * *